US009676119B2

(12) United States Patent
Fromm

(10) Patent No.: US 9,676,119 B2
(45) Date of Patent: Jun. 13, 2017

(54) METHOD AND DEVICE FOR PRODUCING A CONCRETE COMPONENT, AND CONCRETE COMPONENT PRODUCED ACCORDING TO THE METHOD

(75) Inventor: Asko Fromm, Kassel (DE)

(73) Assignee: Universität Kassel, Kassel (DE)

( * ) Notice: Subject to any disclaimer, the term of this patent is extended or adjusted under 35 U.S.C. 154(b) by 536 days.

(21) Appl. No.: 14/345,129

(22) PCT Filed: Jul. 4, 2012

(86) PCT No.: PCT/DE2012/000682

§ 371 (c)(1),
(2), (4) Date: Jun. 13, 2014

(87) PCT Pub. No.: WO2013/037338

PCT Pub. Date: Mar. 21, 2013

(65) Prior Publication Data

US 2014/0284830 A1 Sep. 25, 2014

(30) Foreign Application Priority Data

Sep. 14, 2011 (DE) ..... 10 2011 113 163

(51) Int. Cl.

| | |
|---|---|
| ***B28B 1/00*** | (2006.01) |
| ***B28B 13/02*** | (2006.01) |
| ***B28B 7/46*** | (2006.01) |
| ***B28B 19/00*** | (2006.01) |
| ***E04C 2/06*** | (2006.01) |

(52) U.S. Cl.

CPC ..... *B28B 13/02* (2013.01); *B28B 1/001* (2013.01); *B28B 1/008* (2013.01); *B28B 7/465* (2013.01); *B28B 19/00* (2013.01); *E04C 2/06* (2013.01)

(58) Field of Classification Search

CPC ..... B28B 1/001; E04C 2/06

See application file for complete search history.

(56) References Cited

U.S. PATENT DOCUMENTS

| | | | | |
|---|---|---|---|---|
| 7,753,103 | B1 * | 7/2010 | Rochester | B22C 9/10 164/137 |
| 2005/0212163 | A1 | 9/2005 | Bausinger et al. | |
| 2011/0177188 | A1 | 7/2011 | Bredt et al. | |

FOREIGN PATENT DOCUMENTS

| | | | |
|---|---|---|---|
| DE | 29824448 | U1 | 6/2001 |
| DE | 102004014806 | A1 | 10/2005 |
| DE | 102008059600 | A1 | 6/2010 |
| EP | 0042709 | A1 | 12/1981 |
| EP | 0431924 | A2 | 6/1991 |
| EP | 2063039 | A1 | 5/2009 |
| EP | 2269808 | A1 | 1/2011 |
| FR | 736007 | A | 11/1932 |
| WO | WO-2005023524 | A2 | 3/2005 |
| WO | WO-2005097476 | A2 | 10/2005 |

(Continued)

*Primary Examiner* — Erin Snelting
(74) *Attorney, Agent, or Firm* — Dinsmore & Shohl LLP

(57) ABSTRACT

The subject matter of the invention is a method for producing a concrete component (1), wherein a plurality of layers of a dry mixture consisting of at least one silicate former and one hydraulic binder are deposited one atop another on a base (7), wherein after applying each layer the respective layer is mixed with water, wherein the contour of the area that is mixed with water correlates with the desired shape of the concrete component (1) at the level of the respective layer to be applied.

4 Claims, 4 Drawing Sheets

(56) References Cited

FOREIGN PATENT DOCUMENTS

| | | | |
|---|---|---|---|
| WO | WO-2009/037550 | A2 | 3/2009 |
| WO | WO-2011087564 | A1 | 7/2011 |

* cited by examiner

METHOD AND DEVICE FOR PRODUCING A CONCRETE COMPONENT, AND CONCRETE COMPONENT PRODUCED ACCORDING TO THE METHOD

CROSS REFERENCE TO RELATED APPLICATIONS

This application is the U.S. National Stage of PCT/DE2012/000682, filed Jul. 4, 2012, which claims priority to German Patent Application No. 10 2011 113 163.2, filed Sep. 14, 2011, both of which are incorporated herein by reference in their entirety.

FIELD OF THE INVENTION

The present disclosure relates on the one hand to a method and a device for manufacturing a concrete component and on the other hand to a concrete component manufactured according to this method.

BACKGROUND OF THE INVENTION

Concrete components are known in various shapes and sizes. In the past, concrete was substantially only used for the manufacture of structures, more specifically of buildings or bridges. However, over time, the scope of application of concrete has been expanded. Thus, it is known to manufacture machine beds out of concrete. Such machine beds for example are no longer produced from conventional concrete, used more specifically in the past in the building industry, but from special concrete and here more specifically from UHPC concrete mixes. Such ultrahigh performance concretes are characterized amongst others in that the components manufactured from them have substantially smaller dimensions while achieving the same strength value as with conventional concretes. As has already been explained, this makes it possible to use such concretes not only for building structures but also for components having a very complex structure.

Pouring concrete into a mold to form it is known. However, such molds are disadvantageous in that depending on the complexity of the component to be cast, the molds become enormously expensive. This is due to the fact that just as in plastic injection molding, it is necessary to provide molds with slide bars. However, manufacturing special molds for corresponding components implies manufacturing a considerable number of parts, due to the considerable cost of molding with the special mold, because otherwise such a mold could not be amortized.

SUMMARY OF THE INVENTION

The problem underlying the invention therefore consists in providing a method for manufacturing concrete components and, more specifically, of structured concrete components with recesses and undercuts that is inexpensive and also allows for cost-effective manufacture of small batches, and moreover allows for high-precision manufacture of concrete components.

In order to solve the problem, it is proposed according to the invention that several layers of a dry mixture of at least one silicate former and a hydraulic binder are deposited above one another on a base, wherein after depositing each layer, that respective layer is mixed with water, the contour of the surface mixed with water being correlated to the desired shape of the concrete component in the height of the respectively applied layer. This clearly shows that the method according to the invention is based on so-called 3D printing. This means that the digitized dimensions of the desired shape of the concrete component are input into a corresponding printer, which then carries out the construction of a corresponding component in layers, by first applying the dry mixture in layers whereupon the individual layers are wetted with water.

In this regard it is additionally provided that the individual layers are applied onto each other in determined time intervals, the time interval depending on the progress of the setting process of the respectively lower layer. From this, it is clear that a requirement for applying an additional layer is that the lower layer has at least partially set. Frequently enough, this is already the case when the respectively lower layer has been wetted with water in the dedicated places. This means that the next mixture layer is applied immediately after the previous layer has been wetted with water. Therefore, a certain degree of setting must be ensured, so that the contour of the lower layer is maintained when the next layer is applied and does not deviate from the defined contour due to the dead weight of the layer or layers above, i.e. so that a dispersion of the lower layer is prevented. On the other hand, it must be ensured that the layers still have some moisture allowing for a material bond between the individual layers, so that a homogenous component is formed.

In detail it has turned out that when the layer has a thickness of 0.05 to 5 mm, and preferably of 0.1 mm, a relatively short time interval is needed for the setting process once the water has been sprayed onto the layer, so that after the end of the spraying process, the next layer can be immediately applied at the other end of the layer. This means that a substantially continuous fabrication is possible.

The method according to the invention allows for manufacture of concrete components that were so far not manufacturable at all or only with considerable difficulty and costs. More specifically, this method allows for manufacturing concrete components that have undercuts, respectively also recesses running in different spatial directions.

Another object of the invention is a device for manufacturing a concrete component assembled from several superimposed layers of a dry mixture and from at least one silicate former and one hydraulic binder, the respectively top layer being mixed with water. The manufacture of three-dimensional objects is known from 3D-printing technology (DE 10 2008 059 600 A1). There, epoxy resin and polyamide based materials are used as printing materials. When using epoxy resin and polyamide, there is basically no limitation for using the heads for discharging the corresponding material. In a liquid or paste-like state, epoxy resin and polyamide are sprayable through nozzles that are so fine that a sharp contouring of the component is possible. However, the object of the invention is not the manufacture of components from such epoxy resins or polyamides but the manufacture of complex structured concrete components. When producing concretes at least one silicate former as well as a hydraulic binder, more specifically Portland cement is used. Without using molds, the mixture of a silicate binder and for example sand and cement is not readily adapted for manufacturing a sharply contoured structured concrete component. Since the respectively last layer or top layer of the dry mixture of the silicate former and hydraulic binder is now wetted with water, it is now possible to provide a sharply contoured component by sharply contoured wetting of the layer with water. In this respect, it is provided that the device for manufacturing the concrete component includes two discharge heads, which are respectively disposed so as to be displaceable in at least one spatial direction on a frame, wherein the one discharge head serves for discharging the dry mixture of at least one silicate former and a hydraulic binder and the other discharge head serves for discharging the water. The discharge head for the dry mixture is displaceable in at least one spatial direction. The discharge head for the water in particular is mobile in at least two dimensions, preferably three dimensions, since, as has already been explained, the contouring of the individual layers and therefore the contouring of the concrete component built in layers will ultimately occur by way of the discharge head for the water, configured more specifically as a spray nozzle. This means that the spray nozzle is configured in the manner of a print head.

According to another feature of the invention, it is provided that the discharge head is configured as a discharge channel, the discharge channel having a slot-like discharge opening. This results in the following method for manufacturing a contoured component with undercuts and/or hollows. The discharge head configured as a discharge channel is first displaced at an equal speed above a base. The dry mixture of the hydraulic binder and the silicate former are first discharged as a layer onto the base via the slot-like opening of the discharge channel. Immediately after that, the layer is sprayed with water. The water is sprayed onto the layer through the discharge head correspondingly configured as a spray head or print head, according to the contour of the desired component. This means that by applying several layers above one another, an e.g. cube-shaped body is formed. The discharge heads are also advantageously vertically displaceable for discharging the dry mixture as well as for discharging the water. Alternately it is also conceivable to correspondingly lower the base on which the cube is built.

The desired structured component is located in the cube. Since only the areas that ultimately form the structured concrete component have been wetted with water, the remaining surfaces are not wetted with water. This means that the concrete has not set in those places. If the actual component is removed from the cube, a powder or a granular residue of the mixture remains that has not set simply because certain surfaces of the layers have not come in contact with water. Hollow spaces in the structure concrete component must be blown out or sucked out in order to expose the hollow spaces. With undercuts the mixture simply trickles out.

It has already been explained elsewhere that the layer-by-layer construction of such a structured concrete component can substantially only take place in such a manner that once the water has been sprayed onto the respectively last layer, it cannot be overlaid with another layer until that layer has set to a certain extent. This happens relatively quickly with low layer densities so that a continuous application and wetting is possible. If the layer-by-layer construction occurred too quickly, i.e. without waiting until the individual layers have set, the entire body would ultimately disperse due to a certain load on the lower layers.

Another object of the invention is a concrete component that has been produced according to the previously described method. Such a concrete component is characterized by one or several recesses, e.g. tubelike hollow spaces, a liquid or paste-like hardenable mass being introducible into the one or several recesses. The mass can be made of plastic or of a liquid metal.

It is known that concrete components are highly resistant to compressive forces but do not resist at all or only to a small extent to tensile forces. Therefore, in order to be able to transfer tensile forces with a concrete component, the use of reinforcements is always required. The most widely known are so-called constructional steels, which have circumferential ribs for increasing the friction in the concrete component. Introducing reinforcements particularly into the strongly contoured and structured concrete components that are the object of the present invention is barely or not at all possible. However, since such structured components are now manufacturable, it is also possible to provide recesses in the concrete component during manufacture, the geometry of which optimally adapts to the force flow of acting forces that cannot be absorbed by the concrete itself or only to a very limited extent. As has already been explained, the recesses are filled with a liquid or paste-like hardenable mass after completion of the concrete component. In this respect, such plastics or metals that are poured into the corresponding recesses in the concrete component can serve as reinforcements. From this, it becomes immediately clear that assuming that the recesses in the concrete component serve to receive materials that are able to transmit tensile forces, as is the case for example with corresponding plastics and with metals, a component produced according to the method of the invention is able to transmit not only compressive forces but also tensile forces. Thus, a composite component is created, the load-bearing capacity of which can be greater than that of its individual components.

In this context it is provided according to a particular feature that in its hardened state the mass protrudes from the recess and thus serves to directly connect with another concrete component for example.

In the following, the invention is exemplarily described in more detail based on the drawings.

DETAILED DESCRIPTION OF THE INVENTION

Figure 1:
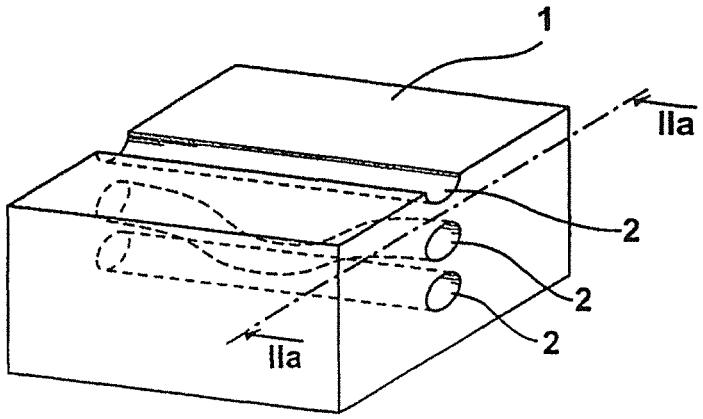
FIG. 1 is a perspective view of a concrete component of the type according to the invention.

In accordance with the representation of FIG. 1, the concrete component is labeled 1. The concrete component 1 shows three superimposed recesses 2 that serve to receive a reinforcement. One recess extends in three spatial directions in order to show the possibilities offered by the method according to the invention.

Figure 2:
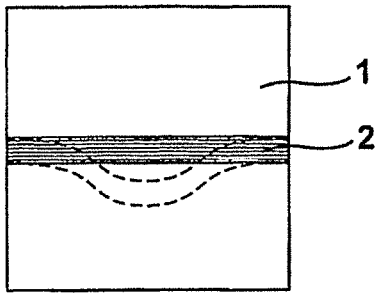
FIG. 2 is a top view of the concrete component according to FIG. 1.
Figure 2A:
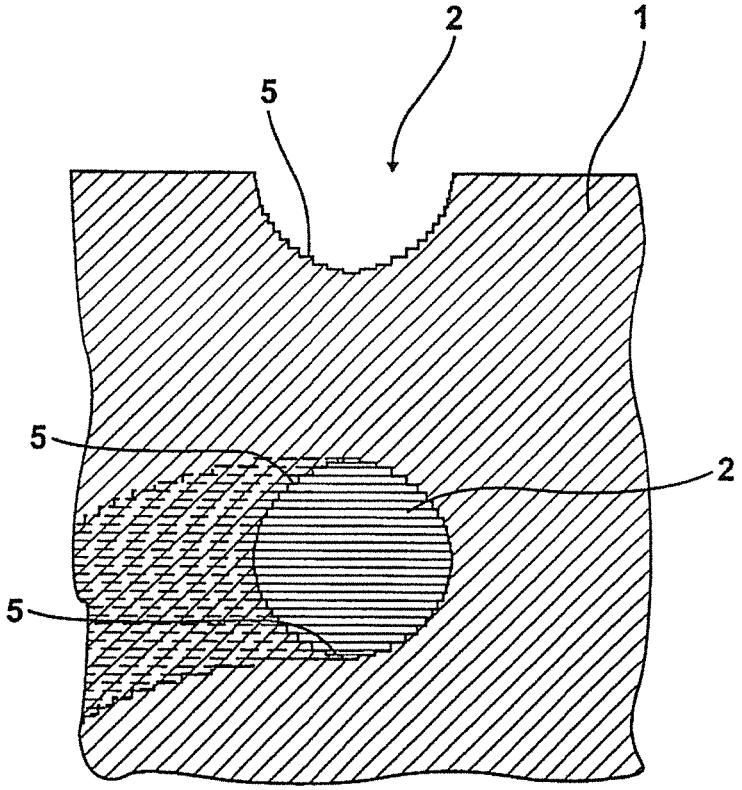
FIG. 2*a* is a cross sectional view of the hollow space the concrete part taken along line IIa/IIa in FIG. 1.

FIG. 2 and FIG. 2*a* show the structure in the area of the top and middle recess 2, which runs obliquely in the concrete component. The individual layers 5 of the concrete component in the area of the recess 2 are visibly configured in such a manner that they are discontinued stepwise toward the outside, and then converge again toward the top after reaching the lateral apex of the approximately circular recess. As has already been explained, manufacture of the recess 2 occurs by depositing the individual layers of the dry mixture above one another. The layers are only wetted with water in those places where the layer must set in order to form the concrete component. In this respect, layers of the dry mixture are also located in the hollow space to be formed, the layers above the horizontal apex of a substantially circular recess being supported by the underlying layers that have not been sprayed with water. The dry mixture in the recess that has not set trickles out of the recess when the component is picked up from the base or is blown out.

Figure 3:
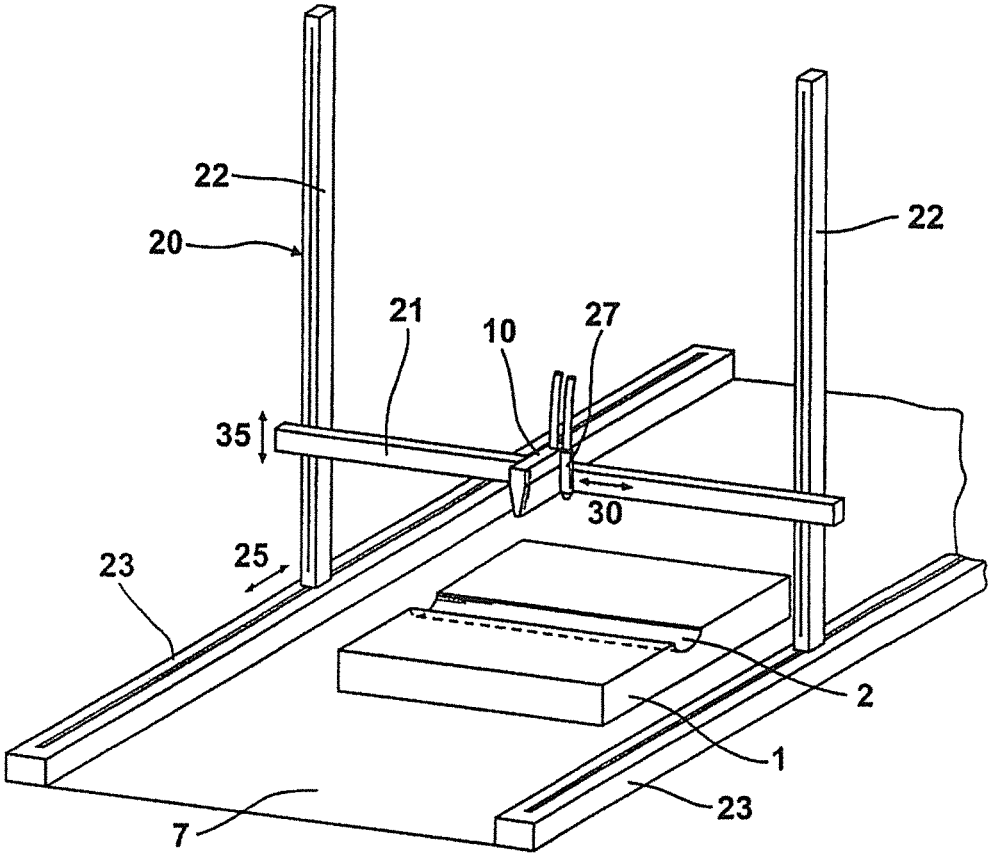
FIG. 3 is a perspective view of a device for manufacturing a concrete component.
Figure 4:
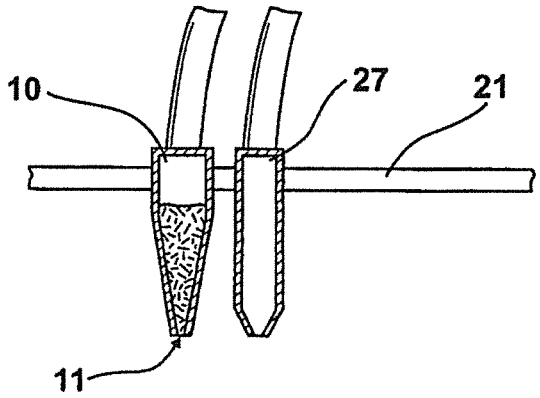
FIG. 4 is a lateral view of FIG. 3.

The device according to FIG. 3 is characterized by a discharge head 10 that is displaceable in three spatial directions and is configured as a discharge channel and is disposed on a crossbeam 21. The crossbeam 21 is held by two supports 22, which are displaceable on rails 23 in the direction of the arrow 25. The crossbeam 21 is held by the supports 22 so that it is vertically movable (arrow 35). Together with the rails 23 and the supports 22, the crossbeam 21 forms the frame 20. Another discharge head 27 configured as a spray head, which serves to discharge water, is located on the discharge head 10.

The discharge channel is disposed on the crossbeam so that it is movable in the direction of the arrow 30 and the discharge head 27 is configured as a spray head and is attached to the discharge channel. The channel and head are therefore displaceable in three spatial directions.

On its bottom side, the discharge head 10 configured as a discharge channel comprises a slot-like discharge opening 11 for the mixture of the hydraulic binder and the silicate former, e.g. sand. The spray head serves for sharply contoured spraying of water.

The procedure for manufacturing a structured concrete component can be described as follows: first a layer of the mixture of the hydraulic binder and the silicate former is applied onto the base 7 by the discharge head 10 configured as a discharge channel. In a top view, the layer has for example a rectangular shape. The layer is then sprayed with water in accordance with the desired contour. Once the layer has set or at least partially set to the extent that it has become stiff, a layer of the dry mixture is again applied onto the first layer in a rectangular shape. This layer is then also sprayed with water in accordance with the desired contour of that layer. The entire procedure is continued on a layer-by-layer basis until the body of the concrete part is completed. The concrete part is then lifted off the base. The non-set mixture detaches itself from the concrete part or concrete body; hollow spaces in the concrete part can be emptied with pressurized air.

Figure 2B:
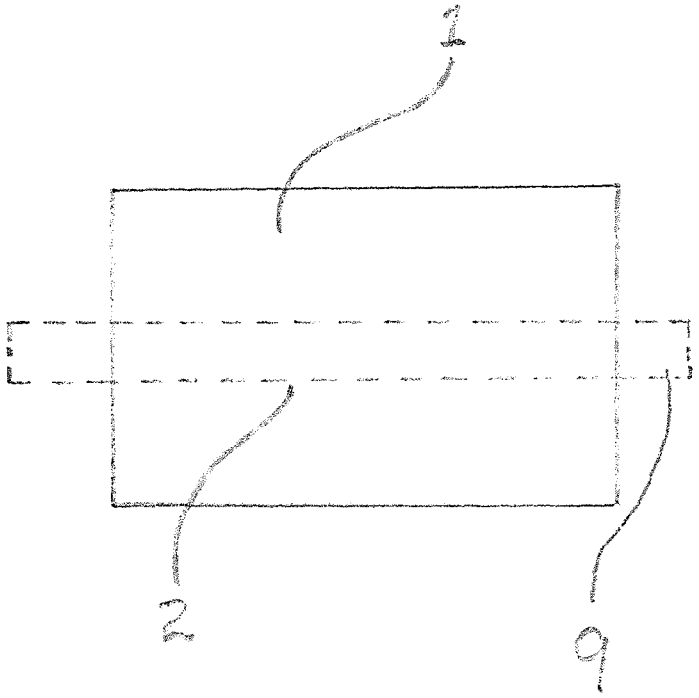
FIG. 2*b* shows a view from above onto a concrete component with a mass in a hardened state protruding from a recess.

As shown in FIG. 2*b*, a hardenable mass 9 can be introduced into the hollow spaces 2, which is able to absorb tensile forces once it has hardened. The hardened mass can be for example a plastic, for example a synthetic resin.

The invention claimed is:

1. A method for manufacturing a reinforced concrete component, comprising:

depositing a plurality of layers of a dry mixture above one another on a base, the dry mixture including at least one silicate former and a hydraulic binder;

after application of each layer of the dry mixture, mixing at least a portion of the respective layer with water, the portion of the respective layer that is mixed with water is a contour correlated to a desired shape of a concrete component, the concrete component having one or more recesses;

introducing a liquid or paste-like hardenable mass into the one or more recesses, the liquid or paste-like hardenable mass being a plastic or a metal; and hardening the liquid or paste-like hardenable mass into a hardened state, the mass in the hardened state protruding from the one or more recesses and forming a reinforcement of the reinforced concrete component.

2. A method in accordance with claim 1, wherein the plurality of layers are applied onto each other in determined time intervals, the time intervals depending on the progress of the setting process of a respective lower layer.

3. A method in accordance with claim 1, wherein the layers have a thickness in the range of 0.05 to 5 mm.

4. A method in accordance with claim 3, wherein the layers have a thickness of 0.1 mm.

* * * * *